United States Patent [19]

Fischer

[11] 4,189,861

[45] Feb. 26, 1980

[54] ASSEMBLY KIT AND A CONNECTING ELEMENT FOR CONNECTING STRUCTURAL ELEMENTS THEREOF

[76] Inventor: Artur Fischer, Weinhalde 34, D-7244 Waldachtal 3, (Tumlingen), Fed. Rep. of Germany

[21] Appl. No.: 871,108

[22] Filed: Jan. 20, 1978

[30] Foreign Application Priority Data

Feb. 25, 1977 [DE] Fed. Rep. of Germany ..... 2708129

[51] Int. Cl.[2] ..... A63H 33/10

[52] U.S. Cl. ..... 46/26; 46/17

[58] Field of Search ..... 46/26, 16, 17, 23, 29

[56] References Cited

U.S. PATENT DOCUMENTS

| | | | |
|---|---|---|---|
| 2,132,647 | 10/1938 | Robins | 46/26 |
| 2,225,612 | 12/1940 | Allen | 46/26 |
| 2,735,146 | 2/1956 | Purviance | 46/26 |

*Primary Examiner*—Louis G. Mancene
*Assistant Examiner*—Paul J. Hirsch
*Attorney, Agent, or Firm*—Michael J. Striker

[57] ABSTRACT

An assembly kit has a first hollow structural element having a face and at least one groove open at the face, a second hollow structural element having a wall surface positionable onto the face of the first structural element, and at least one further groove extending inwardly of the wall surface, and a substantially U-shaped connecting element having two elongated portions connected with one another by an intermediate portion. One of the elongated portions of the connecting element is insertable into the groove of the first structural element, whereas the other elongated portion of the connecting element is insertable into the further groove of the second structural element when the wall surface of the second structural element is positioned on the face of the first structural element so as to connect the structural element with one another. The elongated portions of the connecting element are spaced from one another by the intermediate portion at a distance such that when the elongated portions of the connecting element are inserted in the grooves of the structural elements the connecting element is clamped on the wall surface of the second structural element.

14 Claims, 3 Drawing Figures

ASSEMBLY KIT AND A CONNECTING ELEMENT FOR CONNECTING STRUCTURAL ELEMENTS THEREOF

BACKGROUND OF THE INVENTION

The present invention relates to an assembly kit and a connecting element for connecting hollow structural elements of the assembly kit with one another.

Assembly kits have been proposed in the art, in which hollow structural elements are connected with one another either by a base plate provided with several undercut projections or pins, or by a structural element which has undercut slots provided in its one side face and undercut projections provided on its opposite side surface. However, it frequently happens that in assembling of toy models from structural elements a structural element does not have connecting means on the face on which another structural element must be positioned. Open sides of hollow structural elements are frequently closed with covers provided with construction means forming an aperture, such as a door, a window or the like. When two hollow structural elements have covers provided with such means forming a window or a door and formed in faces located at right angles relative to one another, then one of the hollow structural elements must be positioned on the face of the other structural element which is not provided with connecting means.

SUMMARY OF THE INVENTION

Accordingly, it is an object of the present invention to provide an assembly kit and a connecting element thereof which avoids the disadvantages of the prior art.

More particularly, it is an object of the present invention to provide an assembly kit and a connecting element which makes possible to connect hollow structural elements with one another in a simple manner and without changing geometry or scale of the thus-assembled structure.

Another object of the present invention is to provide an assembly kit and a connecting element which make possible to connect hollow structural elements with one another so that their open ends are located at a right angle relative to one another.

In keeping with these objects and with others which will become apparent hereinafter, one feature of the present invention resides, briefly stated, in an assembly kit which has a first hollow structural element having a face and at least one groove open at the face, a second hollow structural element having a wall surface positionable onto the face of the first structural element and at least one further groove extending inwardly of the wall surface, and a substantially U-shaped connecting element having two elongated portions connected with one another by an intermediate portion. One of the elongated portions of the connecting element is insertable into the groove of the first structural element, whereas the other elongated portion of the connecting element is insertable into the further groove of the second structural element when the wall surface of the second structural element is positioned on the face of the first structural element so as to connect the structural elements with one another. The elongated portions of the connecting element are spaced from one another by the intermediate portion at a distance such that when the elongated portions of the connecting element are inserted in the grooves of the structural elements, the connecting element is clamped on the wall surface of the second structural element. It is advantageous when the further groove of the second structural element has an enlarged section located in the region of the face surface and the second elongated projection of the connecting element is insertable in this enlarged section.

In order to assemble a toy model, that is to connect hollow structural elements with one another, the U-shaped connecting element is moved by its open side so that one of the elongated portions thereof is inserted into the enlarged section of the groove of the second structural element and to such an extent that the intermediate portion of the connecting element abuts against a wall of the second structural element bounding the enlarged section of the groove. Due to specific transverse dimensions of the intermediate portion and specific distance between the elongated portions, the connecting element is firmly clamped on the wall of the structural element when its elongated portion is inserted in the groove of the latter. The other elongated portion of the connecting element which is located above an outer surface of the structural element gives a possibility to connect another structural element to the first-mentioned structural element. The other hollow structural element may be, then, shifted over the other elongated portion of the connecting element located above the outer surface of the first-mentioned structural element and connected to the latter on a surface thereof which is not provided with connecting means. It is advantageous when two such connecting elements are used for connecting two hollow structural elements of an assembly kit with one another. Since the elongated portions of the connecting element abut directly on the outer surfaces of the hollow structural elements connected with one another, geometry and scale of the latter are not changed in an assembled condition thereof.

When an assembly kit and a connecting element is constructed in accordance with the present invention, it is possible to connect hollow structural elements with one another so that their open sides are located at a right angle relative to one another. When respective cover members are inserted in the open ends of the hollow structural elements a toy model is formed which has an especially original appearance. For example, it is possible to assemble a toy model in which one of the hollow structural elements has an open front side and forms a stove, whereas the other hollow structural element positioned above the first-mentioned hollow structural element has an upper open side which can be closed by a cover so as to form a stove plate.

Another feature of the present invention is that the intermediate portion of the connecting element is insertable into the enlarged section of the groove of the second structural element and has dimensions corresponding to the dimensions of this enlarged section. This correspondence assures parallel location of the connecting element to the lateral sides of the structural elements and secure orientation of the connecting element so that the hollow structural elements cannot turn relative to one another in an assembled condition. Furthermore, this construction also assures that the closed front face of a connecting element is snugly connected with the outer face of the hollow structural element. A base plate is provided which has undercut projections or pins insertable in the grooves of the second structural element and adapted to completely close the wall of the second structural element provided with these grooves. The base plate prevents the connecting element from displacement in a direction opposite to the direction of insertion of the connecting element into the grooves of the hollow structural elements.

Still another feature of the present invention is that the elongated portion of the connecting element insertable into the groove of the second structural element is shorter than the elongated portion insertable into the groove of the first structural element. Since the first-mentioned elongated portion of the connecting element insertable into the groove of the second structural element is shorter therefore a cover plate can be inserted into an open side of the second hollow structural element. The cover plate has generally cup-shaped configuration and dimensions corresponding to the dimensions of a hollow of the second hollow structural element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
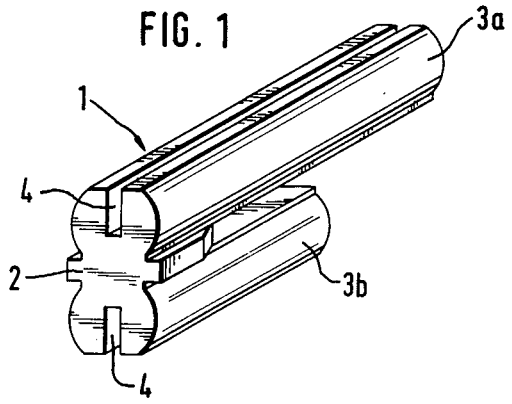
FIG. 1 is a perspective view showing a connecting element for connecting hollow structural elements of an assembly kit, in accordance with the present invention.
Figure 2:
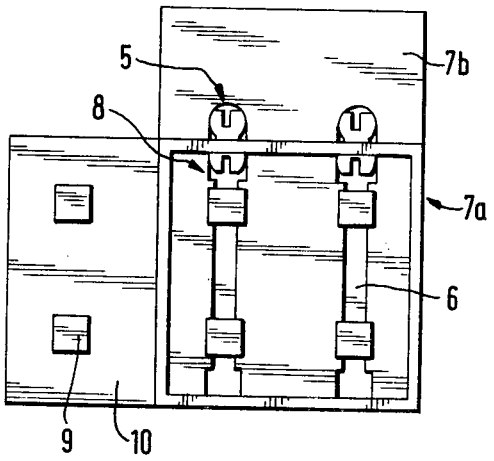
FIG. 2 is a front view showing a connecting element which connects two hollow structural elements of an assembly kit with one another.
Figure 3:
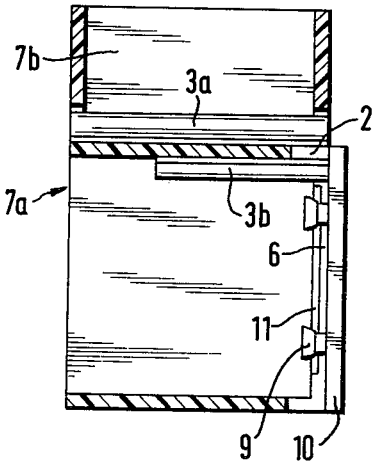
FIG. 3 is a side view of the elements shown in FIG. 2.

A connecting element of an assembly kit for connecting hollow structural elements is shown in FIG. 1 and identified in toto by reference numeral 1. It has two elongated portions 3*a* and 3*b* which are connected with one another by an intermediate portion 2 so as to form a U-shaped contour. As can be clearly seen from FIG. 1, the elongated portions 3*a* and 3*b* are formed as undercut formations and provided with elongated slots 4 so as to improve their deformability. Two hollow structural elements 7*a* and 7*b* of an assembly kit to be connected with one another are shown in FIGS. 2 and 3. They have two elongated slots 6 formed with recesses 8 and enlarged sections 5. A distance between the elongated portions 3*a* and 3*b* of the connecting element 1 is so dimensioned with respect to the thickness of a wall of the hollow structural element 7*a* that when the connecting element 1 connects the hollow structural elements 7*a* and 7*b* with one another the connecting element is in clamping engagement with the hollow structural element 7*a*. The intermediate portion 2 of the connecting element 1 has dimensions corresponding to the dimensions of the enlarged portion 5 of the slot 6 so as to assure that the connecting element is parallel to the lateral sides of the structural elements in an assembled condition. As clearly shown in FIG. 1, the elongated portion 3*b* of the connecting elements is shorter than the elongated portion 3*a* thereof.

In order to connect the connecting element 1 with the hollow structural element 7*a*, the shorter elongated portion 3*b* of the connecting element is inserted into the recess 8 of the slot 6, and the connecting element 1 moves further in this direction until the intermediate portion 2 thereof abuts against a wall of the hollow structural element 7*a* which limits the groove. When the connecting element 1 is so connected with the hollow structural element 7*a*, the second elongated portion 3*a* of the connecting element 1 is located on an outer surface of the hollow structural element 7*a* and another structural element can be connected to the latter. After this, the structural element 7*b* is fitted on the longer elongated portion 3*a* of the connecting element 1. When the connecting element 1 is so inserted into the hollow structural element 7*a* and 7*b*, an outer surface of a bottom wall of the hollow structural element 7*a* is substantially flush with a face of the connecting element 1 which is opposite to an insertion end thereof. A base plate 10 is positioned on the outer surface of the bottom wall of the hollow structural element 7*a*. Since the base plate 10 overlaps the above-mentioned face of the connecting element 1 the latter is prevented from displacement relative to the structural elements 7*a* and 7*b* in a direction opposite to the direction in which the connecting element 1 is inserted into the hollow structural elements. The base plate 10 is secured to the hollow structural element 7*a* by undercut pins 9 provided on the base plate 10 and engaging in undercut sections 11 of the grooves 6.

It will be understood that each of the elements described above, or two or more together, may also find a useful application in other types of constructions, differing from the types described above.

While the invention has been illustrated and described as embodied in an assembly kit and a connecting element for connecting hollow structural elements of the assembly kit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An assembly kit, comprising a first structural element having a face and at least one groove which is open at said face; a second structural element having a wall which has a predetermined thickness and a surface which is positionable onto said face of said first structural element, said second structural element having at least one further groove extending inwardly of said wall; and a substantially U-shaped connecting element having two elongated portions each having two sections which are spaced from one another in a direction of elongation, said elongated portions of said connecting element being connected with one another by an intermediate portion only in the region of their one end sections so that remainder sections of said elongated portions are not connected with one another and spaced from one another to form a gap therebetween which has a transverse dimension substantially equal to the thickness of said wall of said second structural element, one of said elongated portions of said connecting element being insertable into said further groove of said second structural element so that the remainder section of said one portion extends completely inwardly of said wall, the remainder section of the other elongated portion extends completely outwardly of said wall, the wall is received in said gap between said remainder sections of said elongated portions, and said connecting element is firmly clamped on said wall of said second structural element as a result of said dimensioning of said gap, said other elongated portion of said connecting element being insertable into said one groove of said first structural element so as to connect the structural elements with one another.

2. An assembly kit as defined in claim 1, wherein said intermediate portion has a thickness corresponding to the thickness of said wall of said second structural element.

3. An assembly kit as defined in claim 1, wherein said surface of said wall of said second structural element is an outer surface, said wall further having an inner surface, the remainder section of said one elongated portion of said connecting element abutting against said inner surface of said wall, whereas the remainder section of said other elongated portion of said connecting element abutting against said outer surface of said wall in assembled condition.

4. An assembly kit as defined in claim 1, wherein said elongated portions of said connecting element and said remainder sections thereof are parallel to one another.

5. The assembly kit as defined in claim 1, wherein at least said further groove of said second structural element has an enlarged section located in the region of said surface of said wall.

6. The assembly kit as defined in claim 1, wherein at least the elongated portion insertable into said groove of said first structural element is formed as an undercut projection, and said groove of said first structural element is formed as an undercut groove adapted to receive said undercut projection.

7. The assembly kit as defined in claim 1, wherein said further groove of said second structural element has an enlarged section located in the region of said surface of said face, and having predetermined dimensions, said intermediate portion of said connecting element being insertable into said enlarged section and having dimensions corresponding to the dimensions of the latter.

8. The assembly kit as defined in claim 1, wherein the elongated portion insertable into said first structural element has a predetermined length, and the elongated portion insertable into said second structural element has a length which is smaller than the length of the former.

9. A connecting element for connecting a first structural element having a face and at least one groove which is open at said face with a second structural element having a wall which has a predetermined thickness and a surface which is positionable onto said face of said first structural element, and at least one further groove extending inwardly of said wall, the connecting element comprising two elongated portions each having two sections which are spaced from one another in a direction of elongation, said elongated portions of said connecting element being connected with one another by an intermediate portion only in the region of their one end sections so as to form a substantially U-shaped contour and so that remainder sections of said elongated portions are connected with one another and spaced from one another to form a gap therebetween which has a transverse dimension substantially equal to the thickness of said wall of the second structural element, one of said elongated portions of said connecting element being insertable into the further groove of the second structural element so that the remainder section of said one portion extends completely inwardly of said wall, the remainder section of the other elongated portion extends completely outwardly of said wall, the wall of the second structural element is received in said gap between said remainder sections of said elongated portions, and said connecting element is firmly clamped on the wall of the second structural element as a result of said dimensioning of said gap, said other elongated portion being insertable into the one groove of the first structural element so as to connect the structural elements with one another.

10. A connecting element as defined in claim 9, wherein said intermediate portion has a thickness corresponding to the thickness of the wall of said second structural element.

11. A connecting element as defined in claim 9, wherein the surface of the wall of the second structural element is an outer surface, the wall further having an inner surface, the remainder section of said one elongated portion of said connecting element abutting against the inner surface of said wall, whereas the remainder section of said other elongated portion of said connecting element abutting against the outer surface of said wall in assembled condition.

12. A connecting element as defined in claim 9, wherein said elongated portions of said connecting element and said remainder sections thereof are parallel to one another.

13. The connecting element as defined in claim 9, wherein the further groove of the second structural element has an enlarged section located in the region of said face surface and having predetermined dimensions, said intermediate portion being insertable into the enlarged section and having dimensions corresponding to the dimensions of the latter.

14. The connecting element as defined in claim 9, wherein said first elongated portion of said connecting element has a predetermined length, and said second elongated portion thereof has a length which is smaller than the length of said first elongated portion.

* * * * *